US008136429B2

(12) United States Patent
Wu

(10) Patent No.: US 8,136,429 B2
(45) Date of Patent: Mar. 20, 2012

(54) REVERSIBLE MONKEY WRENCH

(75) Inventor: Arthur Wu, Taichung Hsien (TW)

(73) Assignee: Proxene Tools Co., Ltd., Taichung Hsien (TW)

( * ) Notice: Subject to any disclaimer, the term of this patent is extended or adjusted under 35 U.S.C. 154(b) by 315 days.

(21) Appl. No.: 12/636,380

(22) Filed: Dec. 11, 2009

(65) Prior Publication Data

US 2011/0120277 A1 May 26, 2011

(30) Foreign Application Priority Data

Nov. 25, 2009 (TW) ..... 98140175 A

(51) Int. Cl.
*B25B 13/16* (2006.01)
*B25B 13/20* (2006.01)

(52) U.S. Cl. ..... 81/165; 81/170

(58) Field of Classification Search ..... 81/165–173, 81/126

See application file for complete search history.

(56) References Cited

U.S. PATENT DOCUMENTS

| | | | | | |
|---|---|---|---|---|---|
| 1,391,251 | A * | 9/1921 | Ginsburg | ..... | 81/165 |
| 2,562,060 | A * | 7/1951 | Pehrsson | ..... | 81/165 |
| 2,733,626 | A * | 2/1956 | Mesojedec | ..... | 81/165 |
| 2,970,502 | A * | 2/1961 | Nordgren | ..... | 81/165 |
| 3,312,129 | A * | 4/1967 | Nordgren | ..... | 81/165 |
| 3,901,106 | A * | 8/1975 | Causey | ..... | 81/111 |
| 5,746,099 | A * | 5/1998 | Janson | ..... | 81/165 |
| 5,890,404 | A * | 4/1999 | Stojanowski | ..... | 81/165 |
| 6,679,139 | B2 * | 1/2004 | Brenizer | ..... | 81/165 |
| 7,137,321 | B1 * | 11/2006 | Huang | ..... | 81/165 |
| 8,074,540 | B2 * | 12/2011 | Huang | ..... | 81/165 |
| 2010/0263498 | A1 * | 10/2010 | Huang | ..... | 81/170 |

* cited by examiner

*Primary Examiner* — Hadi Shakeri

(57) ABSTRACT

A reversible monkey wrench includes a handle, a head, a slidable jaw, an axial rod and a worm gear. The handle has a connecting end for the head to abut thereagainst. The head is formed with a fixed jaw, a sliding rail, a receiving slot and a connecting bore. The connecting bore communicates with the receiving slot. A movable pin and a spring are disposed between the connecting end and the head. A top of the movable pin selectively inserts through the connecting bore. The spring urges the movable pin so that the movable pin may abut against the connecting end. The worm gear is adapted to control the slidable jaw to move and is slidably disposed in the receiving slot with respect to the axial rod. The movable pin selectively abuts against the worm gear to prohibit the worm gear from sliding.

14 Claims, 9 Drawing Sheets

REVERSIBLE MONKEY WRENCH

BACKGROUND OF THE INVENTION

1. Field of the Invention

The present invention relates to a monkey wrench, and more particularly to a reversible monkey wrench.

2. Description of the Prior Art

Monkey wrenches are one of the most common types of hand tools. Some of them are designed to be reversible, in which they can drive a nut in one direction and run idle in the reverse direction, so that they would not have to disengage from the nut after every turning stroke.

Some reversible monkey wrenches are provided with slidable jaws that move away from the fixed jaw when they are reversely turned, such as disclosed in U.S. Pat. No. 1,391,251, U.S. Pat. No. 2,562,060, U.S. Pat. No. 2,733,626, U.S. Pat. No. 2,970,502, U.S. Pat. No. 5,809,404 and U.S. Pat. No. 7,137,321. These patents mainly disclose a monkey wrench with a worm gear being slidable, along with its axial rod, in a receiving slot of a head, and thereby a slidable jaw thereof can move away from a fixed jaw. Some other patents such as U.S. Pat. No. 3,312,129, U.S. Pat. No. 5,746,099 and U.S. Pat. No. 6,679,139 disclose similar design except that their worm gears are slidable along the axial rods. The heads of the above mentioned wrenches are, however, wider than usual.

In addition, most of the above mentioned wrenches use resilient members to push either the worm gears or the axial rods to their original position. Accordingly, how to dispose the resilient member, in order to minimize the size of the head, is yet another topic of the present invention.

SUMMARY OF THE INVENTION

The main object of the present invention is to provide a reversible monkey wrench whose head is smoothly rotatable with respect to the handle.

Another main object of the present invention is to provide a reversible monkey wrench with smaller size.

To achieve the above and other objects, a reversible monkey wrench of the present invention includes a handle, a head, a slidable jaw, an axial rod and a worm gear. The handle has a connecting end for the head to pivot thereon. The head is formed with a fixed jaw, a sliding rail, a receiving slot and a connecting bore. The connecting bore communicates with the receiving slot. A movable pin and a spring are disposed between the head and the connecting end. A top of the movable pin selectively inserts through the connecting bore. The spring surrounds the movable pin and abuts against the movable pin and the head, so that a bottom of the movable pin may abut against the connecting end at all time. The worm gear is disposed in the receiving slot and is slidable along the axial rod. The movable pin selectively abuts against an abutting end of the worm gear so as to prohibit the worm gear from sliding along the axial rod.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figures 1, 1A:
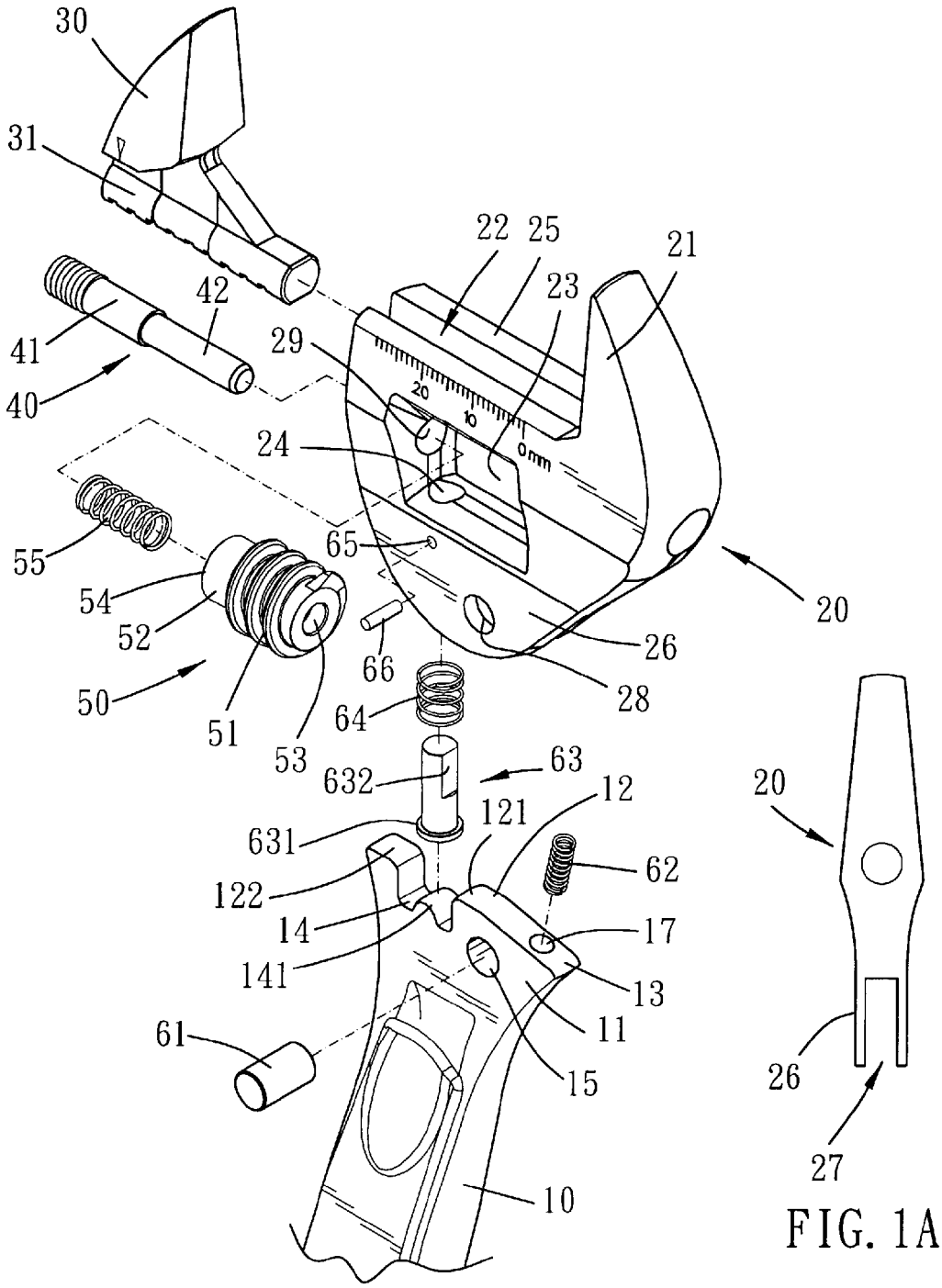
FIG. 1 is a breakdown drawing showing a first embodiment of the present invention.
FIG. 1A is a lateral view of a head of the present invention.
Figure 2:
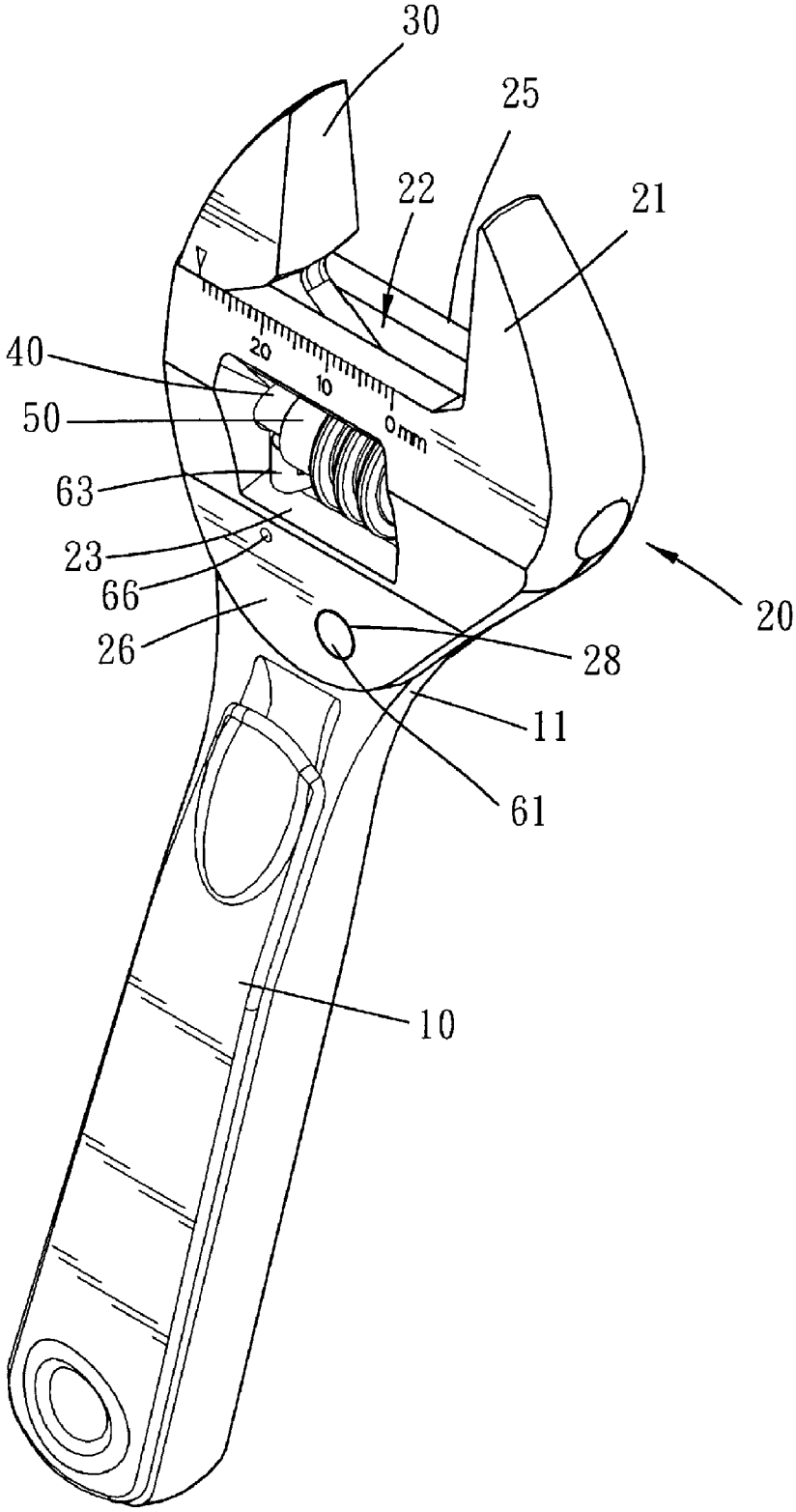
FIG. 2 is a combination drawing showing a first embodiment of the present invention.
Figure 3:
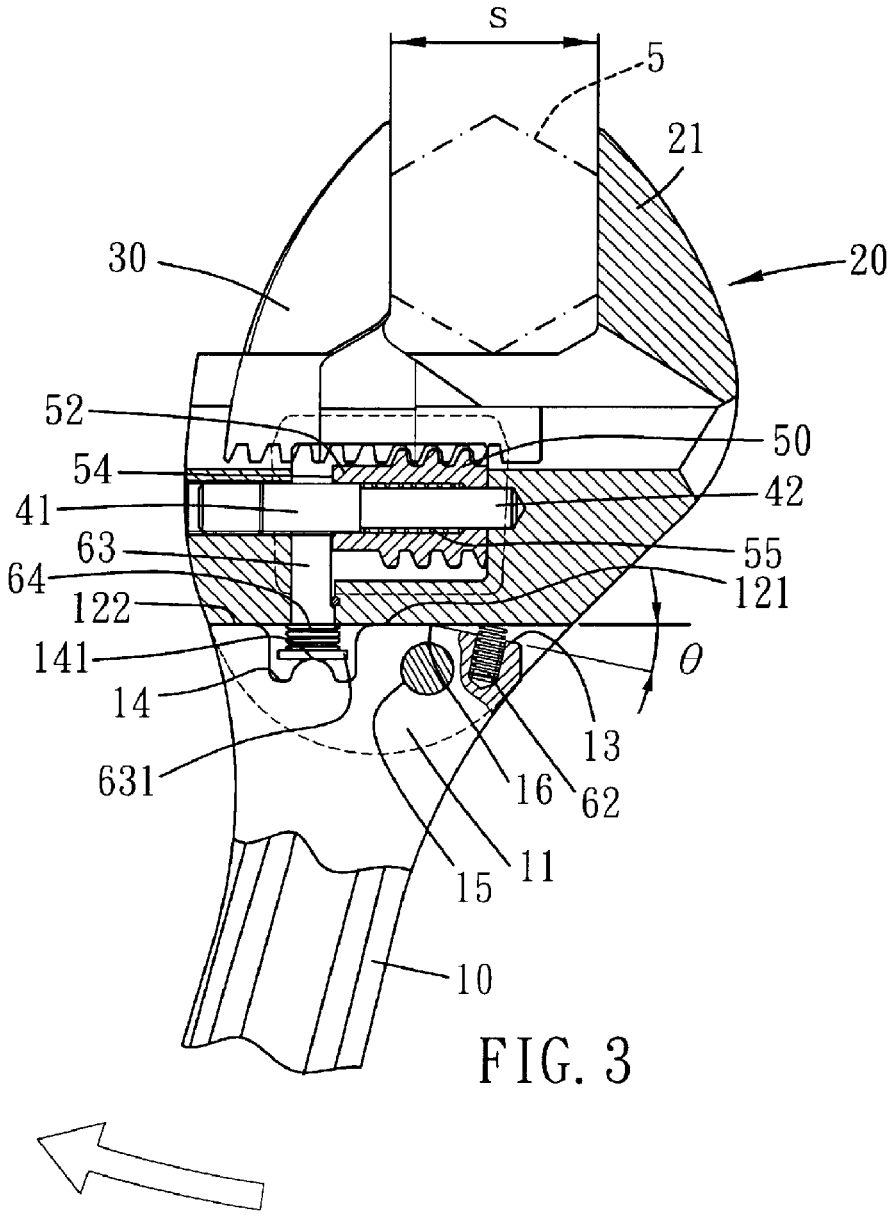
FIG. 3 is a partial profile showing a first embodiment of the present invention.

Please refer to FIG. 1 to FIG. 3 for the first embodiment of the present invention. A reversible monkey wrench of the present embodiment includes a handle 10, a head 20, a slidable jaw 30, an axial rod 40 and a worm gear 50.

Figure 1B:
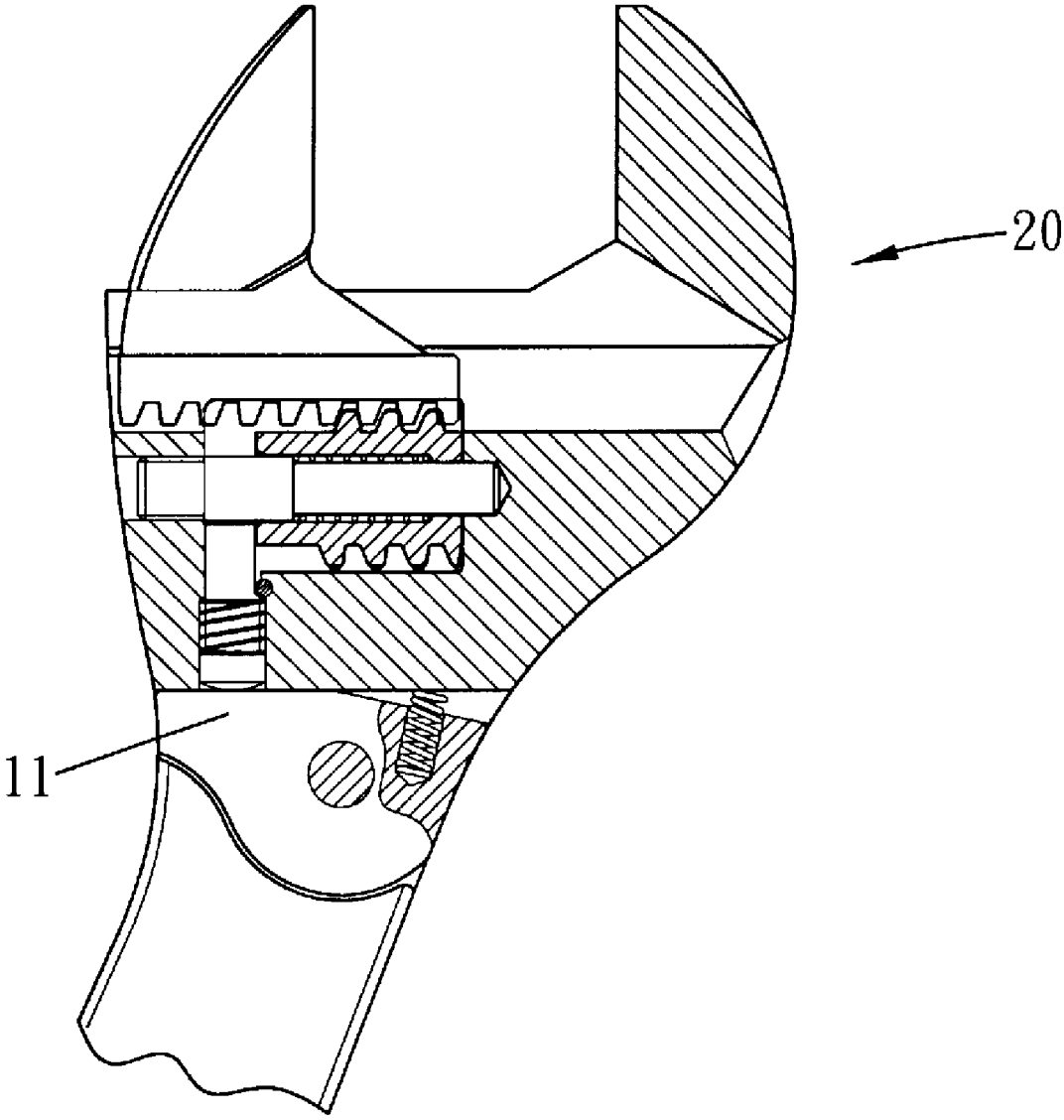
FIG. 1B is a profile showing another embodiment of the present invention.

The handle 10 has a connecting end 11. Another end of the handle 10 may also be provided with a driving head (not shown). More specifically, the connecting end 11 has a working abutting face 12, an idle abutting face 13, an abutting groove 14 and a pivot bore 15. The idle abutting face 13 is formed with a first spring bore 17. The working abutting face 12 and the idle abutting face 13 locate at opposite sides of the pivot bore 15, and a corner 16 is formed at a joint section of the faces 12 and 13, in which the corner 16 is a position closest to the pivot bore 15 among the faces 12 and 13. Note that the corner 16 may also be rounded. The working abutting face 12 makes an angle of θ to the idle abutting face 13. The working abutting face 12 includes a first section 121, which is close to the pivot bore 15, and a second section 122, which is remote from the pivot bore 15. The first section 121 connects to the idle abutting face 13, and the abutting groove 14 locates between the first and second sections 121 and 122. A contacting face, such as a protrusive spherical surface 141, is formed on the abutting groove 14, and the contacting face is preferably lower than the working abutting face 12. In other embodiments of the present invention as shown in FIG. 1B, the connecting end 11 may be formed without the abutting groove.

The head 20 is formed with a fixed jaw 21, a lateral disposed sliding rail 22, a receiving slot 23, a connecting bore 24 and a slide surface 25 disposed at a top of the sliding rail 22. The receiving slot 23 communicates with the sliding rail 22, and the connecting bore 24 vertically communicates the receiving slot 23 with a bottom of the head 20. Furthermore, the head 20 has a pair of wings 26 parallelly extending from the bottom thereof, and a departing slot 27 is formed between the wings 26, as shown in FIG. 1A, to receiving the connecting end 11 therein. A pivot bore 28 may be formed on at least one of the wings 26. In addition, a pin bore 65 may be formed on the head 20 along the thickness direction of the head 20, in which the pin bore 65 communicates with the connecting bore 24.

A joint axle 61, a first spring 62, a movable pin 63 and a second spring 64 is disposed between the head 20 and the connecting end 11. The joint axle 61 inserts through the pivot bores 15 and 28, such that the head 20 may be rotatable with respect to the handle 10 about the joint axle 61. The first spring 62 is received in the first spring bore 17, and the first spring 62 abuts against the head 20 and the connecting end 11. A top of the movable pin 63 selectively inserts through the connecting bore 24, and the movable pin 63 has a plane surface 632 axially extending from the top of the movable pin 63. In addition, the movable pin 63 further has an abutting rim 631 radially extending therefrom. The second spring 64 surrounds the movable pin 63 and abuts against the abutting rim 631 and the head 20, such that the second spring may urge a bottom of the movable pin 63 to abut against the connecting end 11—more particularly against the spherical surface 141 of the abutting groove 14—at all time. Note that the first spring 62 should provide an elastic force bigger than an elastic force provided by the second spring 64, so as to enable the working abutting face 12 to spontaneously abut against the bottom of the head 20, i.e. a top surface of the departing slot 27, under a natural circumstance. Moreover, a rotation-free means can be further provided for prohibiting the movable pin 63 from rotating about an axis of the connecting bore 24. In the present embodiment, the rotation-free means includes a rotation-free pin 66 inserting in the pin bore 65 for the plane surface 632 to slide along the pin 66 without rotating. The rotation-free means may be a combination of a rail and a sliding groove, or non-circular cross sections of the connecting bore 24 and the movable pin 63.

Figure 5:
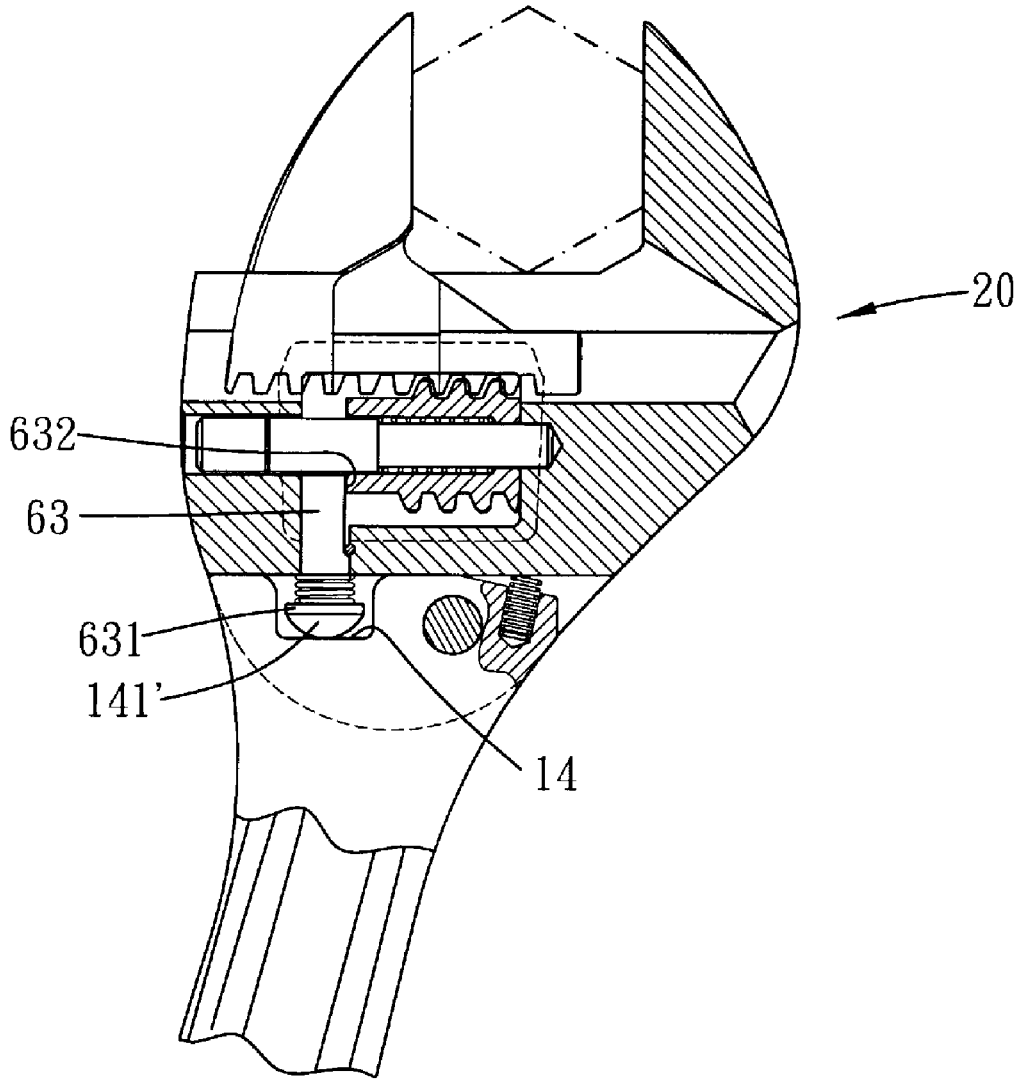
FIG. 5 is a partial profile showing a second embodiment of the present invention.

In the previous embodiments, the spherical surface 141 is disposed on the connecting end 11, yet the bottom of the movable pin 63 may be provided with a protrusive spherical surface 141', in substitution for the spherical surface 141, for the connecting end 11 to abut thereagainst as shown in FIG. 5. Or, both the bottom of the movable pin 63 and the connecting end 11 can be provided without the spherical surface, and therefore the movable pin 63 contacts the connect end 11 directly.

The slidable jaw 30 has a sliding rod 31 slidably disposed in the sliding rail 22 of the head 20. A nut 5 can be, therefore, clamped between the fixed jaw 21 and the slidable jaw 30. A biggest hexagonal nut 5 the monkey wrench can drive has a maximum length of e between two opposite angles thereof, and has a maximum length of s between two opposite sides thereof.

The axial rod 40 inserts through a lateral through bore 29 of the head 20 and is stationarily disposed in the receiving slot 23. The axial rod 40 includes a thicker section rod 41 and a thinner section rod 42.

Figure 3A:
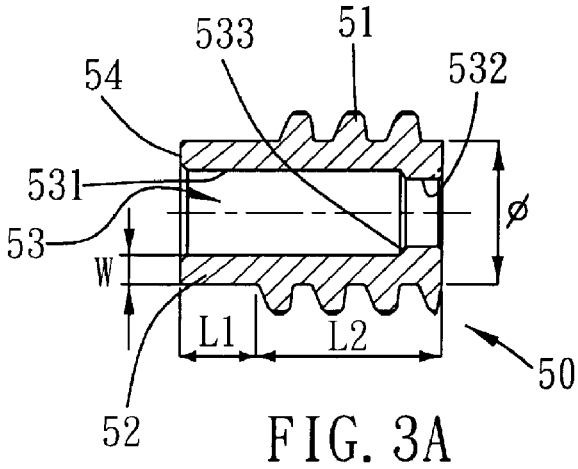
FIG. 3A is a profile showing a worm gear of the present invention.

The worm gear 50 has an engaging portion 51 corresponding to the sliding rod 31, a smooth portion 52, an axial bore 53 for the axial rod 40 to insert therethrough, and an abutting end 54. The engaging portion 51 engages with the sliding rod 31 to control the movement of the slidable jaw 30. The worm gear 50 is disposed in the receiving slot 23 and is slidable along the axial rod 40. As best shown in FIG. 3A, the axial bore 53 includes a wide section bore 531 and a narrow section bore 532. The wide section bore 531 is axially formed from the abutting end 54, and the narrow section bore 532 is also axially formed to communicate with the wide section bore 531. A joint of the wide section bore 531 and the narrow section bore 532 is formed with a shoulder portion 533. The thicker section rod 41 inserts into the wide section bore 531 from the abutting end 54, and the thinner section rod 42 inserts through the narrow section bore 532. An annular space is formed between the thinner section rod 42 and the wide section bore 531 for a third spring 55 to dispose therein. And, the third spring 55 abuts against the thicker section rod 41 and the shoulder portion 533, so as to urge the worm gear 50 to laterally move close to the fixed jaw 21. Furthermore, the abutting end 54 is selectively abutted against by the movable pin 63 to prohibit the worm gear 50 from sliding. Due to the plane surface 632, the movable pin 63 and the abutting end 54 are in a surface contacting relationship. Moreover, the smooth portion 52 locates between the abutting end 54 and the engaging portion 51. A diameter of the smooth portion 52 is no bigger than a root diameter $\phi$, which is a smallest diameter among the engaging portion 51, and a length L1 of the smooth portion 52 is smaller than an axial length L2 of the engaging portion 51.

The working principle of the reversible monkey wrench of the present invention is discussed hereinbelow. Please refer to FIG. 3 first. When the wrench is turned clockwise, the working abutting face 12 abuts against the head 20, pushing the movable pin 63 upward. As such, the plane surface 632 abuts against the abutting end 54 of the worm gear 50. Therefore the slidable jaw 30 and the fixed jaw 21 can tightly clamp and turn the hexagonal nut 5.

Figure 4:
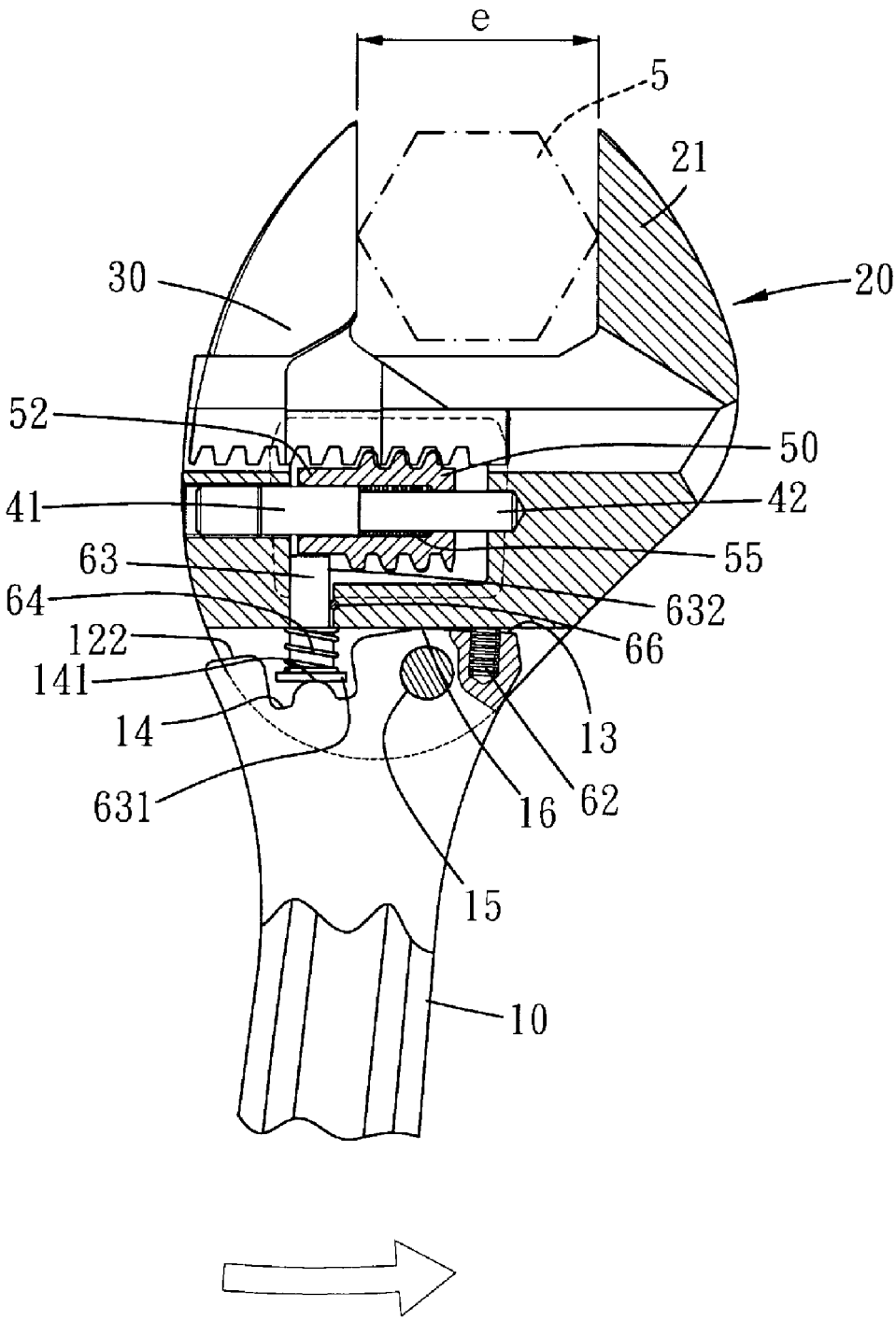
FIG. 4 is a partial profile showing a first embodiment of the present invention.

Please refer to FIG. 3A and FIG. 4 next. When the wrench is turned reversely, the working abutting face 12 disengages from the head 20, and the idle abutting face 13, on the other hand, abuts against the head 20. That is, the handle rotates about the head 20 for an angle equals to the angle $\theta$. The movable pin 63 is pushed down because of the second spring 64, allowing the plane surface 632 to disengage from the abutting end 54. Meanwhile, the nut 5 gives the slidable jaw a horizontal component. As the horizontal component is bigger than the elastic force provided by the third spring 55, the slidable jaw 30 as well as the worm gear 50 slides away from the fixed jaw 21 for a distance no smaller than (e−s). Therefore, the length of the smooth portion 52 is preferably no smaller than (e−s), and a diameter of the movable pin 63 is also no smaller than (e−s).

It is to be noted that when the wrench is turned reversely, a hand of the user should correspondingly turn for an angle of at least $(60°+\theta)$, in which the angle $\theta$ depends on the distance the movable pin 63 should move. In other words, the more distance the movable pin 63 moves, the more the angle $\theta$ increases. Because the worm gear 50 of the present invention is provided with a smooth portion 52 having a smaller diameter, the distance the movable pin 63 should move is only the width W between the periphery of the smooth portion 52 and that of the axial bore 53. As such, the angle $\theta$ is minimized, so that the user won't have to turn his/her arm for a considerable angle that could have caused injury.

In addition, the third spring 55 pushes the worm gear 50 along with the slidable jaw 30 back to their original position once the horizontal component provided by the nut 5 disappears. Due to the elastic force of the first spring 62 being bigger than that of the second spring 64, the handle 10 also spontaneously rotates about the joint axle 61 and pushes the movable pin 63 toward the axial rod 40, as shown in FIG. 3.

Because the third spring 55 is hidden in the annular space defined in the axial bore 53, the width, as well as the volume and the weight, of the head can be minimized.

Figure 6:
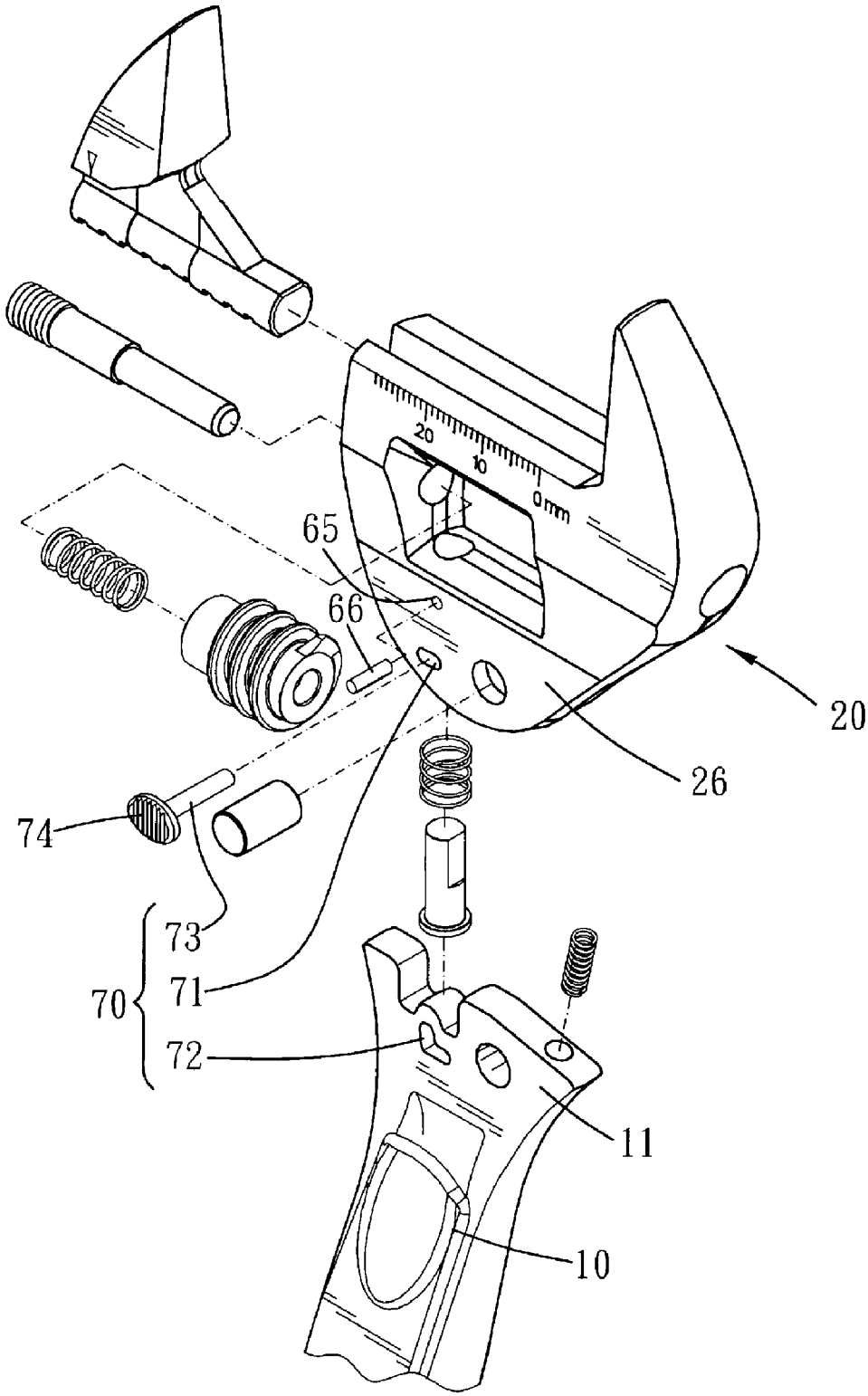
FIG. 6 is a breakdown drawing showing a third embodiment of the present invention.
Figure 7:
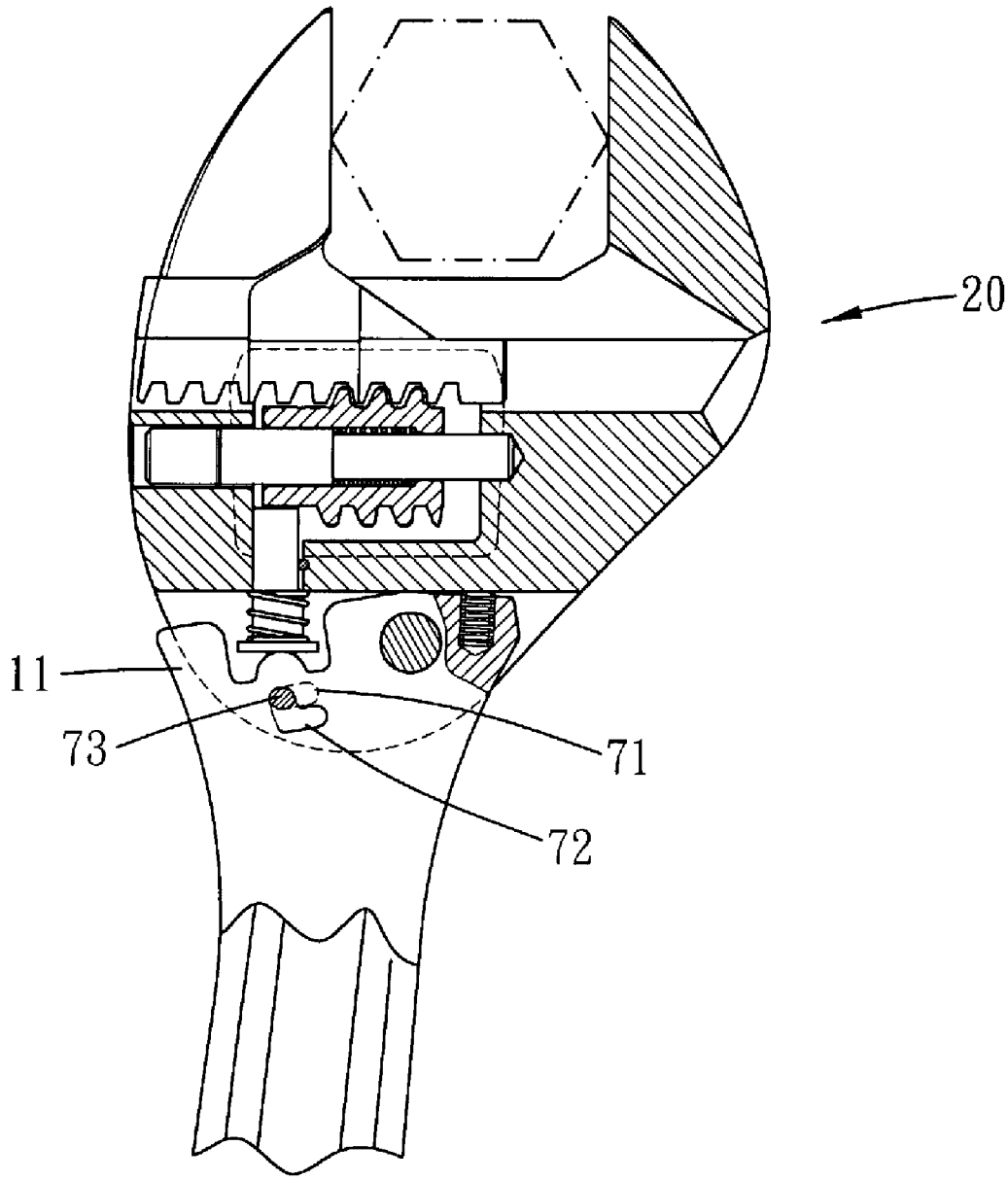
FIG. 7 is a partial profile showing a third embodiment of the present invention.
Figure 8:
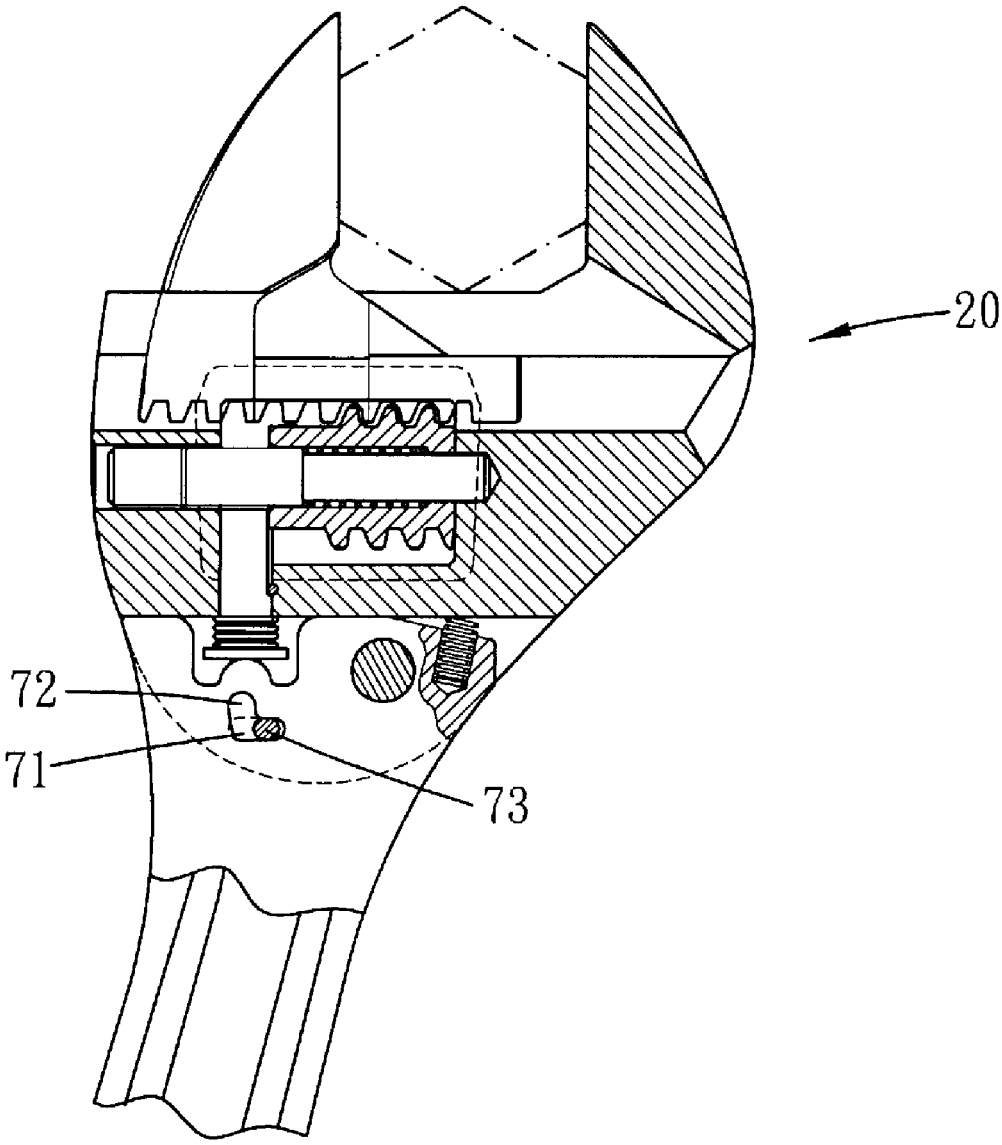
FIG. 8 is a partial profile showing a third embodiment of the present invention.

Please refer to FIG. 6 to FIG. 8 for the third embodiment of the present invention. The wrench of the present embodiment is further provided with a locking device 70. The locking device 70 includes an elongated slot 71, an L-shaped slot 72 and a controlling pin 73. The elongated slot 71 is disposed either on at least one of the wings 26 or on the connecting end 11 (on the wings 26 in the present embodiment), and the L-shaped slot 72 is disposed either on at least one of the wings 26 or on the connecting end 11 where the elongated slot 71 is not disposed (on the connecting end 11 in the present embodiment). The controlling pin 73 inserts through the elongated slot 71 and the L-shaped slot 72, and it is movable between both ends of the elongated slot 71. Preferably, a distal end of the pin 73 is provided with a pushing flange 74 for the user to apply force thereon. As shown in FIG. 7, the pin 73 is at a first end of the elongated slot 71. In this case, the pin 73 can slide in a first travel section of the L-shaped slot 72, and therefore the head 20 is pivotable about the connecting end 11. As shown in FIG. 8, the pin 73 is pushed to a second end of the elongated slot 71. In this case, the pin 73 is retained in the second travel section of the L-shaped slot 72. As such, the head 20 is locked and is not rotatable about the connecting end 11. That is to say, the locking device 70 can adjust the head 20 to be rotatable or nonrotatable with respect to the handle 10.

What is claimed is:

1. A reversible monkey wrench, comprising:

a handle, having a connecting end;

a head, being formed with a fixed jaw, a sliding rail, a receiving slot and a connecting bore, the sliding rail having a slide surface disposed at its top, the receiving slot communicating with the sliding rail, the connecting bore communicating the receiving slot with a bottom of the head; a joint axle, a first spring, a movable pin and a second spring being disposed between the head and the connecting end, the joint axle being located between the first spring and the movable pin, the head being rotatable with respect to the handle and about the joint axle, the first spring abutting against the head and the connecting end, a top of the movable pin selectively inserting through the connecting bore, the second spring being adapted to urge a bottom of the movable pin to abut against the connecting end, the first spring providing an elastic force bigger than an elastic force provided by the second spring;

a slidable jaw, having a sliding rod, the sliding rod being slidably disposed in the sliding rail;

an axial rod, stationarily disposed in the receiving slot;

a worm gear, having an engaging portion corresponding to the sliding rod, and having an axial bore for the axial rod to insert therethrough, the worm gear being disposed in the receiving slot and being slidable along the axial rod, the movable pin selectively abutting against an abutting end of the worm gear so as to prohibit the worm gear from sliding along the axial rod.

2. The reversible monkey wrench of claim 1, wherein the axial bore includes a wide section bore and a narrow section bore, the wide section bore is formed from the abutting end of the worm gear, a joint of the wide section bore and the narrow section bore is formed with a shoulder portion, the axial rod includes a thicker section rod and a thinner section rod, the thicker section rod inserts into the wide section bore from the abutting end, the thinner section rod inserts through the narrow section bore, an annular space is defined between the thinner section rod and the wide section bore, a third spring is disposed in the annular space, the third spring abuts against the thicker section rod and the shoulder portion and is hidden in the worm gear.

3. The reversible monkey wrench of claim 2, wherein the reversible monkey wrench is adapted to drive a hexagonal nut, a length between two opposite angles of the hexagonal nut is e, a length between two opposite sides of the hexagonal nut is s, the worm gear further has a smooth portion locating between the abutting end and the engaging portion, a diameter of the smooth portion is no bigger than a root diameter of the engaging portion, a length of the smooth portion is no smaller than (e−s).

4. The reversible monkey wrench of claim 2, wherein the movable pin has an abutting rim radially extending therefrom, the second spring surrounds the movable pin and abuts against the abutting rim and the head.

5. The reversible monkey wrench of claim 1, wherein the reversible monkey wrench is adapted to drive a hexagonal nut, a length between two opposite angles of the hexagonal nut is e, a length between two opposite sides of the hexagonal nut is s, the worm gear further has a smooth portion locating between the abutting end and the engaging portion, a diameter of the smooth portion is no bigger than a root diameter of the engaging portion, a length of the smooth portion is no smaller than (e−s).

6. The reversible monkey wrench of claim 5, wherein the movable pin has an abutting rim radially extending therefrom, the second spring surrounds the movable pin and abuts against the abutting rim and the head.

7. The reversible monkey wrench of claim 5, wherein a diameter of the movable pin is no smaller than (e−s).

8. The reversible monkey wrench of claim 1, wherein the movable pin has an abutting rim radially extending therefrom, the second spring surrounds the movable pin and abuts against the abutting rim and the head.

9. The reversible monkey wrench of claim 1, wherein the connecting end is formed with a protrusive spherical surface for the bottom of the movable pin to abut thereagainst.

10. The reversible monkey wrench of claim 1, wherein the bottom of the movable pin is formed with a protrusive spherical surface for the connecting end to abut thereagainst.

11. The reversible monkey wrench of claim 1, wherein the movable pin has a plane surface axially extending from the top of the movable pin, the plane surface abuts against with the abutting end of the worm gear.

12. The reversible monkey wrench of claim 1, further comprising a rotation-free means for prohibiting the movable pin from rotating about an axis of the connecting bore.

13. The reversible monkey wrench of claim 1, wherein the head further has a pair of wings parallelly extending from the bottom of the head, a departing slot is formed between the wings to receive the connecting end therein.

14. The reversible monkey wrench of claim 13, further comprising a locking device, the locking device comprising an elongated slot, an L-shaped slot and a controlling pin, the elongated slot being disposed either on at least one of the wings or on the connecting end, the L-shaped slot being disposed either on at least one of the wings or on the connecting end where the elongated slot is not disposed, the controlling pin inserting through the elongated slot and the L-shaped slot, and the controlling pin being movable between both ends of the elongated slot, whereby adjusting the head to be rotatable or nonrotatable with respect to the handle.

* * * * *